US008110729B2

(12) United States Patent
Guthrie et al.

(10) Patent No.: US 8,110,729 B2
(45) Date of Patent: Feb. 7, 2012

(54) PYROLYTIC CARBON COMPONENTS FOR STRINGED INSTRUMENTS

(75) Inventors: James M. Guthrie, Austin, TX (US); Jonathan C. Stupka, Austin, TX (US)

(73) Assignee: Obbligato, Inc., Lakeway, TX (US)

( * ) Notice: Subject to any disclaimer, the term of this patent is extended or adjusted under 35 U.S.C. 154(b) by 0 days.

(21) Appl. No.: 12/698,817

(22) Filed: Feb. 2, 2010

(65) Prior Publication Data

US 2010/0132533 A1 Jun. 3, 2010

Related U.S. Application Data

(63) Continuation of application No. PCT/US2008/072530, filed on Aug. 7, 2008.

(60) Provisional application No. 60/954,613, filed on Aug. 8, 2007.

(51) Int. Cl.
*G10D 3/04* (2006.01)

(52) U.S. Cl. ..... 84/298; 84/299; 84/307; 84/314 N; 84/314 R

(58) Field of Classification Search ..... 84/298, 84/299, 307, 314 N, 314 R, 322
See application file for complete search history.

(56) References Cited

U.S. PATENT DOCUMENTS 934,678 A * 9/1909 Laurian ..... 84/307
1,138,803 A * 5/1915 Shutt ..... 84/298
1,338,583 A * 4/1920 Neft ..... 84/314 N
1,649,376 A * 11/1927 Bacon et al. ..... 84/308
3,547,676 A * 12/1970 Bokros et al. ..... 427/213
3,805,662 A 4/1974 Nishimura et al.
4,304,163 A * 12/1981 Siminoff ..... 84/314 N
4,768,414 A * 9/1988 Wheelwright ..... 84/298
5,052,260 A * 10/1991 Cipriani ..... 84/298
5,092,213 A * 3/1992 Cipriani ..... 84/299
5,125,310 A 6/1992 Lombino
5,227,571 A * 7/1993 Cipriani ..... 84/307
5,265,513 A * 11/1993 Smith ..... 84/298
5,347,905 A * 9/1994 Cipriani ..... 84/298
5,404,783 A 4/1995 Feiten et al.
6,255,568 B1 7/2001 Dunwoodie (Continued)

OTHER PUBLICATIONS

Korean Intellectual Property Office, "Written Opinion of the International Searching Authority" dated Jan. 7, 2009 issued in connection with corresponding International Application No. PCT/US2008/072530, 4 pages.

(Continued)

*Primary Examiner* — Elvin G Enad
*Assistant Examiner* — Robert W Horn
(74) *Attorney, Agent, or Firm* — Fitch Even Tabin & Flannery

(57) ABSTRACT

Pyrocarbon components have been found to create richer, clearer sound when employed as bridges (19), saddles (1), nuts (2), frets (3), tuning heads (4), pegs (9) and other components which contact the strings in guitars (6, 16), violins (11) and like stringed musical instruments. Bridges/saddles and nuts of stringed instruments produce a marked difference in the sound when pyrocarbon components are used compared with currently used materials. There is a significant increase in sound volume for a given intensity of string movement, along with richer harmonics and a clearer, less muddy sound. The crystalline structure of pyrolytic carbon minimizes the damping of string vibration as it is transferred to the sound-amplifying portion of acoustic instruments, producing a rich, pleasing and higher volume sound. The useful life of strings is increased in contact with pyrolytic carbon components before they go "dead" or break.

13 Claims, 7 Drawing Sheets

U.S. PATENT DOCUMENTS

| | | | | |
|---|---|---|---|---|
| 6,521,819 | B1 | 2/2003 | Di Iorio | |
| 6,706,957 | B1 * | 3/2004 | Merkel | 84/314 N |
| 6,815,597 | B1 * | 11/2004 | Bosley | 84/322 |
| 6,870,083 | B2 * | 3/2005 | Turner | 84/298 |
| 7,112,733 | B1 | 9/2006 | Babicz | |
| 7,179,976 | B2 * | 2/2007 | West | 84/322 |
| 7,327,109 | B1 * | 2/2008 | Hagen | 318/298 |
| 7,358,428 | B2 * | 4/2008 | Bell et al. | 84/298 |
| 7,368,646 | B2 * | 5/2008 | Payung | 84/290 |
| 7,507,888 | B2 * | 3/2009 | Rivera et al. | 84/314 R |
| 2010/0132533 | A1 * | 6/2010 | Guthrie et al. | 84/298 |
| 2011/0011476 | A1 * | 1/2011 | Brondum | 137/801 |

OTHER PUBLICATIONS

Korean Intellectual Property Office, "International Search Report" dated Jan. 7, 2009 issued in connection with corresponding International Application No. PCT/US2008/072530, 3 pages.

* cited by examiner

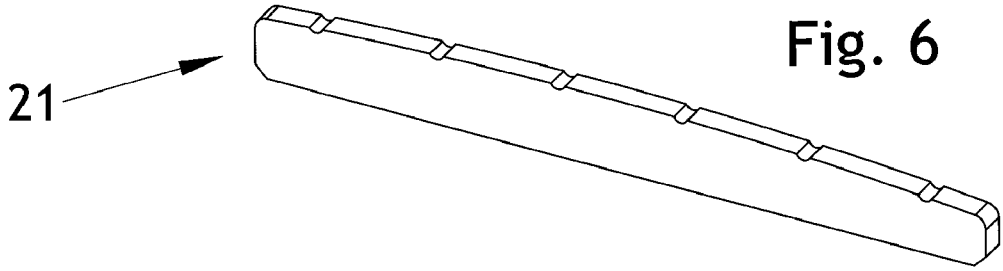
Fig. 6
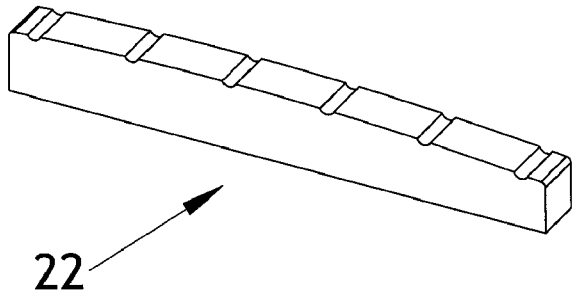
Fig. 7
Fig. 8
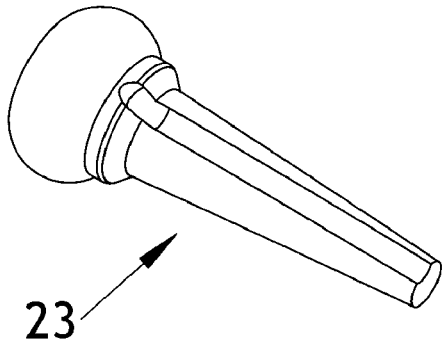

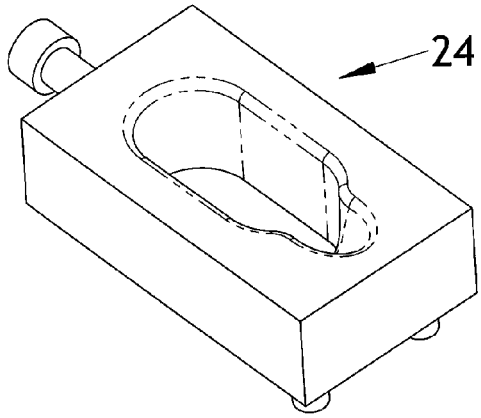
Fig. 9
Fig. 10
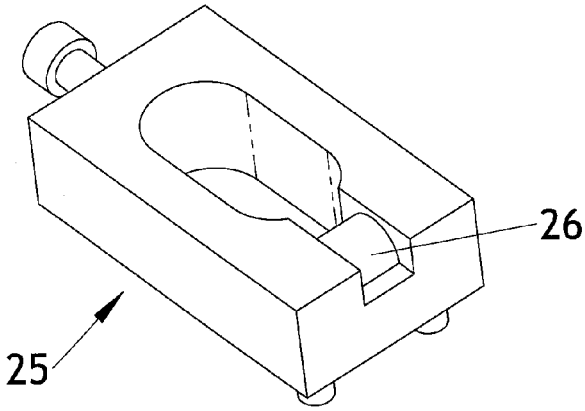
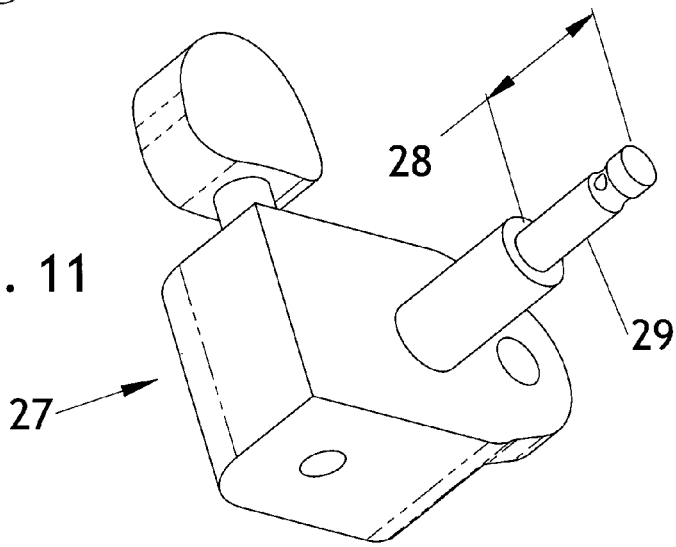
Fig. 11

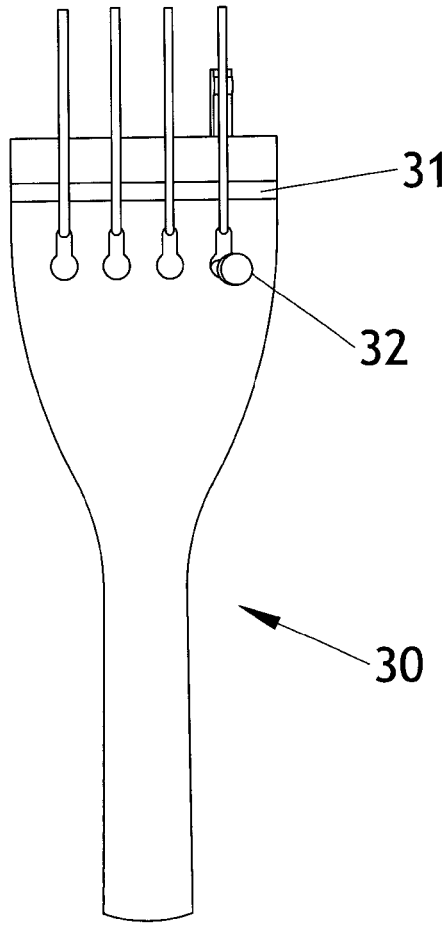
Fig. 12
Fig. 13
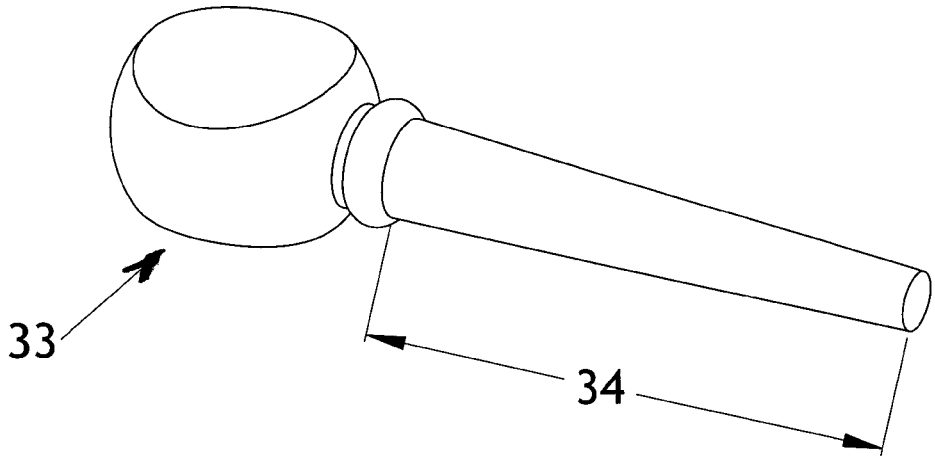

PYROLYTIC CARBON COMPONENTS FOR STRINGED INSTRUMENTS

CROSS REFERENCE TO RELATED APPLICATIONS

This application is a continuation of International Application No. PCT/US2008/072530 filed 7 Aug. 2008 which claims priority from U.S. Provisional Application Ser. No. 60/954,613, filed Aug. 8, 2007, the disclosures of both of which are incorporated herein by reference.

BACKGROUND OF THE INVENTION

Up until now, choices of materials used in stringed musical instruments that come in contact with the strings have not significantly deviated from those traditionally used. Some newer materials have been used, but the tendency seems to be to find more commonly available materials at lower cost as substitutes for materials that are becoming increasingly rare and/or expensive. An example is TUSQ® synthetic material developed to replace bone or ivory particularly for acoustic guitar saddles and nuts. Generally such alternative materials that have been tried in an effort to improve the sonic characteristics of stringed instruments have had some limited success, but overall have produced less than desired results.

U.S. Pat. No. 6,521,819 discloses a V-shaped component that may be placed between electric guitar strings and the saddles/bridge for the purpose of maximizing string life while not affecting sound intonation. It is stated that these components can be made of metal, for example, aluminum or titanium, hardwood, bone, silver, gold, diamond, graphite, hard plastic, chrome, nickel, brass, bronze, or other suitably rigid, hard or soft sheet material.

U.S. Pat. No. 5,227,571 describes a saddle with an inclined lever element extending at an acute angle with respect to its body and having a fulcrum end supported by the bridge. The intent is change direction of string forces to the soundboard in order to enhance volume and sustain. It is said that these components which redirect forces can be made of composites of graphite or carbon fibers, quartz, titanium, aluminum, wood, ivory, synthetic resins, ceramic matrix composites, silicon nitride, ceramic silicon composites, materials that have superconductive properties, metal matrix composites reinforced with ceramic fibers, and metal alloys.

U.S. Pat. No. 5,208,410 discloses an adjustable bridge mechanism that can be added to acoustic guitars which is similar to those now found on some electric guitars. The bridge may be made out of brass, aluminum, steel, other metals and metal alloys, plastics, wood, ceramics, graphite, or various synthetic materials.

U.S. Pat. No. 5,092,213 discloses a guitar saddle with an inclined lever portion. It is stated that the saddle, bridge and wedge can be made of many suitable materials, including wood, aluminum, titanium, ivory, graphite composites, carbon fiber composites, ceramics, quartz, synthetic resins, ceramic matrix composites, silicon nitride, ceramic silicon composites, material with superconductive properties, metal matrix composites reinforced with ceramic fibers, and metal alloys.

U.S. Pat. No. 5,052,260 discloses an adjustable bridge assembly for acoustic guitars and mentions that the saddle and/or the platform member may be made of carbon fiber composites, graphite, silicon ceramics, ceramics with superconductive properties, and ceramic fiber composites.

U.S. Pat. No. 4,960,027 discloses a two piece bridge where one component provides rigidity and the other lubricity. It is mentioned that the component providing lubricity can be made of graphite among other materials

BRIEF SUMMARY OF THE INVENTION

Pyrolytic carbon (particularly, low temperature, turbostatic, isotropic pyrolytic carbon whether in alloyed or unalloyed form), either in a monolithic state or as a composite, i.e. coated upon other substrate materials, when used for bridges/saddles and nuts of stringed instruments, surprisingly produces a marked difference in the sound of these instruments compared with currently used materials. In particular, there is a significant increase in sound volume for a given intensity of string movement along with richer harmonics and a clearer, less muddy sound. It appears that the particular crystalline structure of pyrolytic carbon minimizes the damping of string vibration as it is transferred to the sound-amplifying portion of acoustic instruments producing a rich, pleasing and higher volume sound. Another desirable characteristic of pyrolytic carbon when used for components contacting strings in stringed instruments is an increase in the useful life of the strings, i.e., strings can be used for a longer period of time before going "dead" (losing the level of volume and desirable harmonics). Also, strings that are in contact with pyrocarbon surfaces, versus other material surfaces, last longer before breaking for a given intensity and duration of use. Pyrolytic carbon components also will last longer than other bone, synthetic bone and plastic type components, which tend to yellow and crack and chip as well as to lose intonation as they age.

In one particular aspect, the invention results in a stringed musical instrument which comprises:

(a) two or more abutments that suspend portions of the strings, the spacing of which abutments provides desired primary string vibration frequency or tuning, wherein at least one of the abutments transmits vibrations to a soundboard or sound-amplifying structure;

(b) anchors which hold the strings in place on the abutments and maintain desired string tension, and (c) adjustment means for setting string tension to provide desired base frequency or tuning, the improvement which comprises one or more of components (a), (b) and (c) having surfaces which are in contact with the strings that are formed of pyrolytic carbon as defined herein.

In another particular aspect, the invention results in a plectrum device wherein all of its surface that contacts the strings is formed of pyrolytic carbon for use with a stringed musical instrument where the primary means of initiating string vibration is by plucking with a plectrum device.

In a further particular aspect, the invention results in a stringed musical instrument which incorporates a fretboard as a means of changing primary frequency of the strings, wherein one or more of the frets in the fretboard are formed with pyrolytic carbon surfaces that will come in contact with said strings.

BRIEF DESCRIPTION OF THE DRAWINGS

FIG. 6 is a schematic of an acoustic guitar bridge saddle.

FIG. 7 is a schematic of a guitar nut.

FIG. 8 is a schematic of an acoustic guitar bridge pin.

FIG. 9 is a schematic of an electric guitar adjustable bridge (one is required for each string).

FIG. 10 is a schematic of an electric guitar adjustable bridge modified with a pyrolytic carbon insert.

FIG. 11 is a schematic of a guitar tuning machine head mechanism.

FIG. 12 is a schematic of a violin tailpiece with a fine tuner on the highest pitched string.

FIG. 13 is a schematic of a violin tuning peg.

DETAILED DESCRIPTION OF THE PREFERRED EMBODIMENTS

Figure 1:
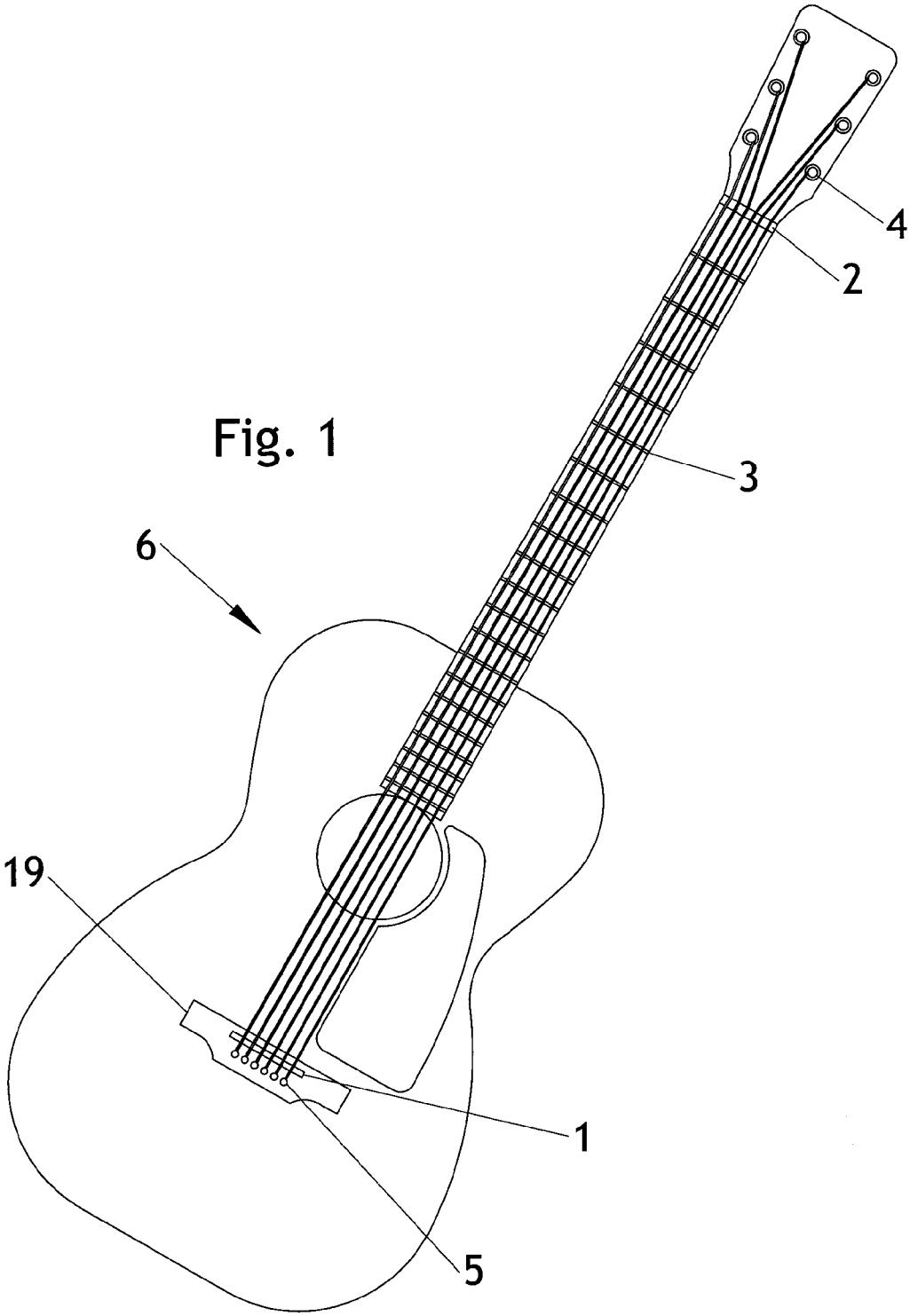
FIG. 1 is a schematic of an acoustic guitar and is representative of stringed instruments employing a finger board to change the pitch of strings where the strings are strummed or plucked.

The invention employs previously unused materials for components that come in contact with strings on stringed instruments; also disclosed is the concept of processing to shape these components to sizes just greater than maximum component size specification in order that they may then be custom fit, as desired, to accommodate tolerances of a particular instrument. The invention is hereinafter described by reference to families of components that come in contact with strings on stringed instruments.

Components such as saddles, bridges and nuts for acoustic guitars, banjos, mandolins, ukuleles, lyres, etc., along with those for violins, violas, cellos, string bass, etc., are preferably made by applying a structural coating of pyrolytic carbon over a high density, isotropic graphite substrate of suitable size and shape. In certain preferred embodiments, the outer geometric envelope of the component is pre-shaped to provide a suitable "blank" using lapping, grinding or sanding operations such that only a minimum amount of material then has to be removed by the person fitting the component to a particular instrument. Such fixed amount of material can be removed by such person to custom fit a particular component to a particular instrument using diamond or silicon carbide abrasives or with other suitable sanding papers/cloths. Blanks may be provided without grooves for string alignment or as shown in FIG. 6 and FIG. 7 with grooves for string alignment.

By pyrolytic carbon or pyrocarbon, which terms are used interchangeably, is meant vapor-deposited carbon which is formed by high temperature, e.g. >1000° C., decomposition of a hydrocarbon. It may be formed either by coating onto a suitable substrate such as one of dense isotropic graphite as well known in this art, or as a monolith, e.g. by deposition onto a surface and then removed from that surface and machined. Pyrocarbon is, by definition, deposited by the high temperature pyrolysis of a carbon-containing substance; it is thus required that the substrate upon which deposition occurs be stable at the fairly high temperatures to which it will be subjected during pyrolysis. Substrates of commercially available isotropic artificial graphite, such as that sold as AFX-5Q and AFX-5Q-10W by POCO Graphite Company, of Decatur, Tex., are generally preferred. However, other artificial graphites having a density between about 1.7 and about 2.1 g/cm$^3$ which are close to perfectly isotropic, e.g. having an isotrophy of about BAF 1.1 or less, may also be used.

Preferably pyrocarbon is deposited in a fluidized bed apparatus, and examples of such fabrication are found in U.S. Pat. Nos. 5,262,104; 5,284,676; 5,328,713; and 6,274,191, as well as in European Patent No. 55,406. The physical characteristics of the pyrocarbon which may be used are generally set forth in the various U.S. patents listed on the title sheet of U.S. Pat. No. 5,514,410, particularly in U.S. Pat. Nos. 3,547,676; 3,676,179; 3,677,795; 3,685,059 and 3,707,006, the disclosures of which are incorporated herein by reference. Very generally, it is felt that the pyrocarbon should have a density of at least about 1.5 cm$^3$, a diamond pyramid hardness of at least about 160 DPH when measured with a 50 gram load, and a crystallite size of between about 20 angstroms and 80 angstroms; it should also be isotropic, i.e. having a Bacon Anisotropy Factor (BAF) between about 1.0-1.5. The pyrocarbon may be unalloyed or may be alloyed with a suitable material, e.g. such as a silicon, as is well known in this art and described in the last mentioned list of patents. Particularly preferred pyrocarbon is that having the characteristics taught in U.S. Pat. Nos. 5,514,410 and 5,677,061, the disclosures of which are incorporated herein by reference, which is referred to in the trade as On-X carbon and is sold commercially by On-X Life Technologies, Inc. of Austin, Tex. This unalloyed carbon has a density between about 1.7 and about 2.1 g/cm$^3$, a DPH of between about 200 and 350, and other properties as detailed in the claims of the '061 patent.

Figure 2:
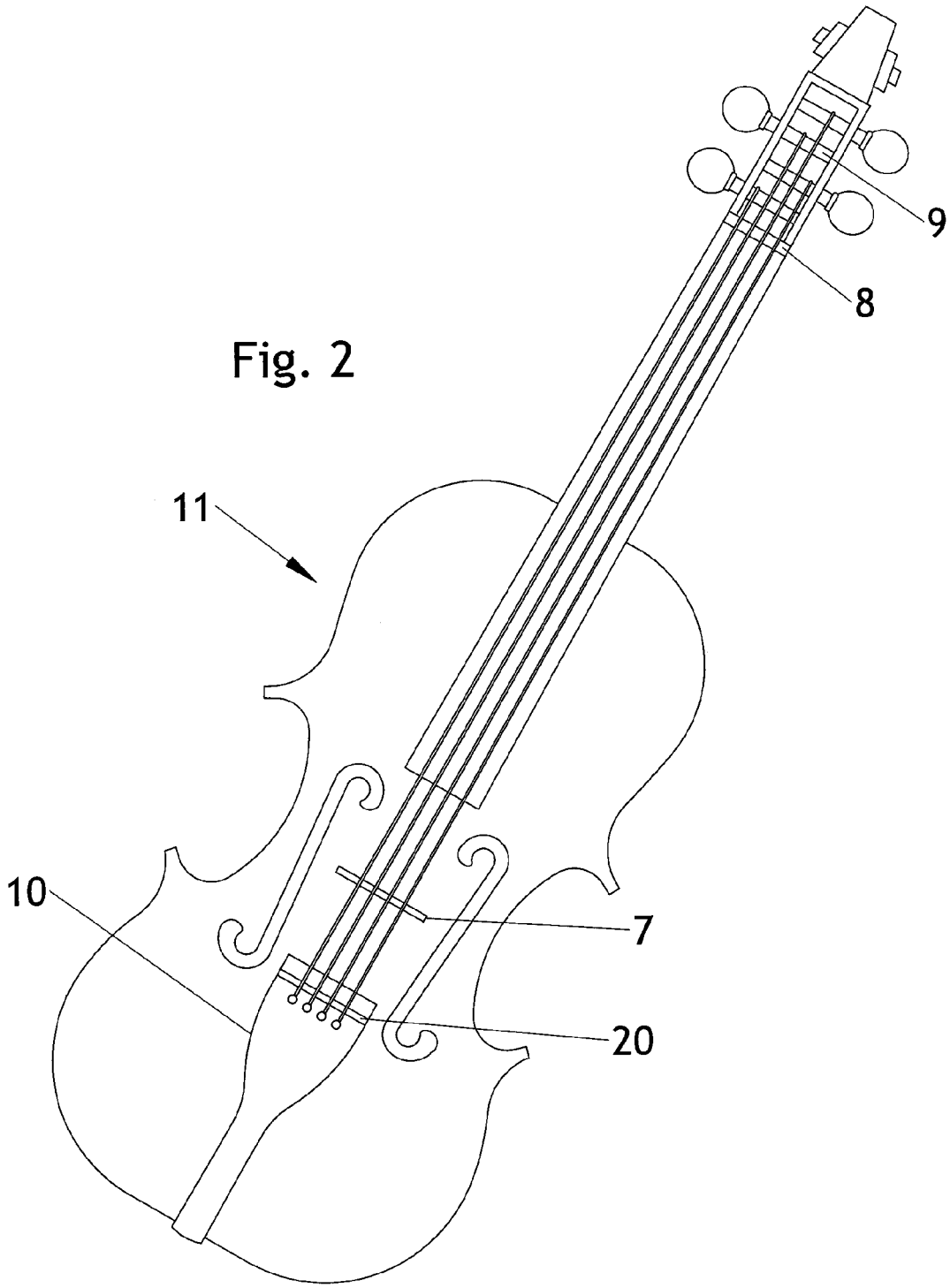
FIG. 2 is a schematic of a violin and is representative of stringed instruments employing a fingerboard to change the pitch of strings where string vibration in initiated and controlled with the use of a bow.

FIG. 1 illustrates an acoustic guitar 6 with a bridge 19 containing a saddle 1. Shapes of saddles vary amongst the various brands of guitars. FIG. 6 illustrates a typical shape saddle 21. FIG. 2 illustrates violin 11 with a bridge 7. Saddles for acoustic guitars and similar instruments along with bridges for violins and similar instruments play an important role as they are a key link between transmitting string vibration energy to the instrument sound bodies. Monolithic pyrolytic carbon and pyrolytic carbon coated over a suitable substrate pre-form, such as a high density, high purity isotropic graphite, significantly improves the transfer of desired string vibration energy relative to currently used materials. Saddle geometry once optimized for a particular guitar is the same for pyrolytic carbon as it is for other materials. Once optimized for a particular instrument, violin bridge geometry for pyrolytic carbon is similar in the region of contact with the body and the strings as other currently used materials, but it is thinner in the middle portion in order to reduce mass by utilizing the strength of the pyrolytic carbon.

FIG. 1 illustrates an acoustic guitar 6 with a nut 2, frets 3, tuning machine heads 4 and bridge pins 5. FIG. 7 provides a more detailed view of a nut 22. FIG. 11 provides a more detailed view of a tuning machine head 27. FIG. 8 provides a more detailed view of bridge pin 23. FIG. 2 illustrates a violin 11 with fingerboard nut 8, tuning pegs 9 and tailpiece nut defined as the last point of contact between the string and the tailpiece 10 towards the bridge 20. The violin fingerboard nut 8 is similar to the guitar nut except for accommodating fewer strings. FIG. 13 provides a more detailed view of a tuning peg 33. FIG. 12 provides a more detailed view of a tailpiece 30 and tailpiece nut 31. This tailpiece has a fine tuning adjuster 32 on the highest pitched string. Tailpieces may have anywhere from zero to four fine tuning adjusters. The tailpiece nut is defined as being the last point of contact towards the bridge between the string and the tailpiece whether or not fine tuning adjusters are used. All of these components also transmit string vibration energy to the instrument, though not nearly to the degree as do the saddles and bridges. However, these components which contact the strings affect string life and benefit from the advantages that pyrolytic carbon offers over currently used materials. Nuts and bridge pins would be made of pyrolytic carbon coated over a suitable substrate pre-form. Violin tuning pegs could either be a complete pyrolytic carbon/substrate pre-form component or could be an assembly of a pyrolytic carbon sleeve, in the region marked 34, and a peg, with the remaining portion of the peg being fabricated from a currently used material and attached using a suitable adhesive. Guitar tuning machine heads would likely also feature a pyrolytic carbon sleeve in the region 28 (FIG. 11) that is attached using a suitable adhesive to the remaining portion of the tuning post 29, which may be fabricated from a currently used material.

Figure 3:
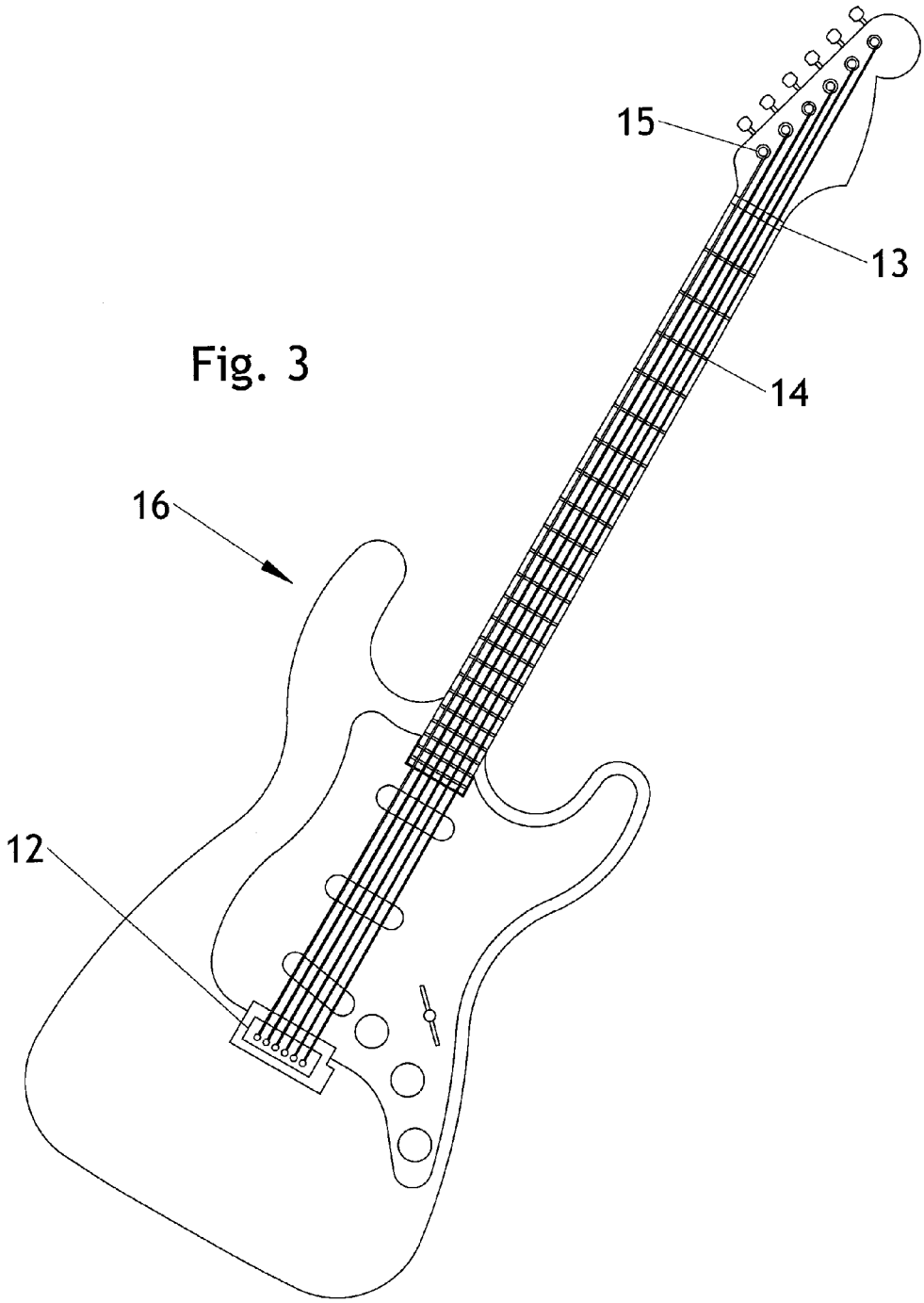
FIG. 3 is a schematic of an electric guitar.

FIG. 3 illustrates an electric guitar 16 with bridge area 12, nut 13, tuning machine heads 15 and frets 14. FIG. 9 provides a more detailed view of an adjustable bridge mechanism 24. Some guitars have individual adjustable bridge mechanisms for each string; guitar 16 is such an example. Other guitars use one adjustable bridge mechanism for all of the strings. FIG. 10 provides a detailed view of an adjustable bridge mechanism 25 that has been modified with a pyrolytic carbon insert 26 that provides the contact surface between the string and the bridge. The pyrolytic carbon insert is attached to the rest of the bridge mechanism which is fabricated with currently used materials using a suitable adhesive, such as an epoxy or cyanoacrylate. In the case of one adjustable bridge being used for all of the strings, a pyrolytic carbon insert similar to 26 would be attached to the bridge under each string.

FIG. 7 provides a more detailed view of the nut 22. As with the case of the acoustic guitar, this piece would preferably be fabricated from pyrolytic carbon coated over a substrate preform. FIG. 11 provides a more detailed view of a tuning machine head 27. As with the case of the acoustic guitar, a pyrolytic carbon sleeve in the area of 28 would be attached using a suitable adhesive to the remaining portion of the tuning post 29 which may be fabricated from a currently used material. Electric guitars might not benefit from the sound-enhancing effects of pyrolytic carbon components quite as much as acoustic guitars because sound is more influenced by the pick ups and basic guitar construction. However, string breakage is a significant problem for electric guitars, especially because smaller gauge strings often tend to be used to facilitate "string bending" while playing. String life is found to be significantly increased when they contact pyrolytic carbon surfaces rather than traditional materials.

The fretboard of both acoustic and electric guitars will have a series of spaced apart frets 3 and 14 aligned perpendicular to the strings; these are usually metal strips of brass, nickel alloy or stainless steel. These frets can have different sizes and shapes so as to allow customizing to a given player's preference. Pyrolytic carbon frets reduce string breakage in addition to providing a smoother, lower friction surface for string bending.

Figure 5:
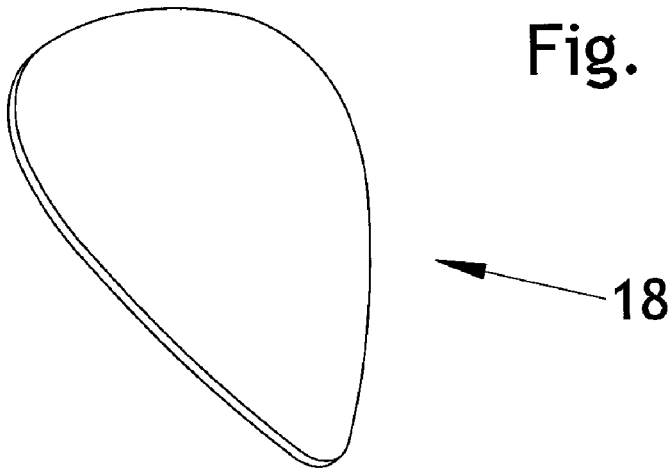
FIG. 5 is a schematic of a plectrum or pick.

In the case of picks 18, fabrication can either be either of dense pyrolytic carbon-coated over a graphite substrate preform or by machining monolithic dense pyrolytic carbon. Of particular interest is the fabrication of a guitar pick or plectrum 18 (FIG. 5) from pyrolytic carbon-coated graphite. Such not only provides the desired level of stiffness, but its gliding action against the strings produces a unique sound, compared to various plastic and metal picks. It is expected that this sound resulting from the interaction of pyrolytic carbon with strings will prove to be particularly desirable to a number of discriminating musicians.

Figure 4:
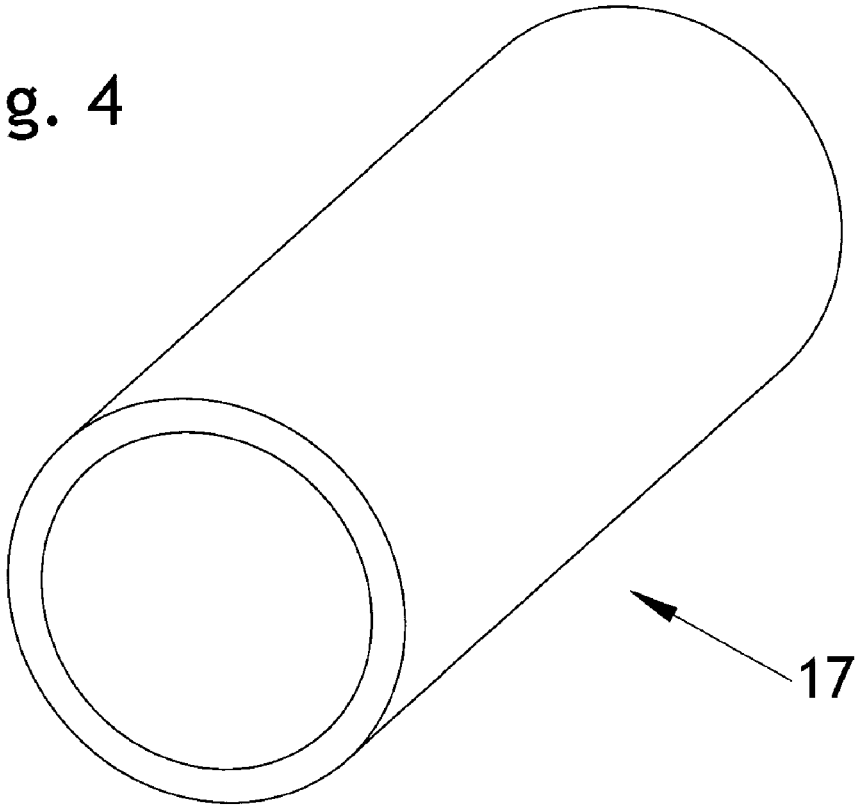
FIG. 4 is a schematic of a finger slide.

It is also felt that this characteristic sound may also find favor among number of musicians when such is used as a material for a finger slide; one example of a finger slide 17 is shown in FIG. 4, which may be made of a pyrolytic carbon-coated graphite substrate.

For both picks 18 and finger slides 17, the pyrocarbon surface finish can be either slightly textured or highly polished. The choice would simply depend upon the particular musician's preference for how he or she would like these surfaces to interact with strings.

Although the invention has been described with regard to certain preferred embodiments which constitute the best mode known to the inventors at this time for carrying out their invention, it should be understood that various changes and modifications as would be obvious to one having ordinary skill in this art, may be made without departing from the scope of the invention which is defined by the claims appended hereto. For example, although artificial graphite is well described as the preferred substrate, it should be understood that other comparable materials can be used which would be satisfactory for high-temperature coating operations. Piano strings are connected to the soundboard through a piano bridge and bridge pins, both of which could be coated with pyrocarbon.

The invention claimed is:

1. In a stringed musical instrument which comprises:

(a) two or more abutments that suspend portions of the strings, the spacing of which abutments provides desired primary string vibration frequency or tuning, wherein at least one of the abutments transmits vibrations to a soundboard or sound-amplifying structure;

(b) anchors which hold the strings in place on the abutments and maintain desired string tension, and (c) adjustment means for setting string tension to provide desired base frequency or tuning, the improvement which comprises one or more of components (a), (b) and (c) having surfaces which are in contact with the strings that are formed of pyrolytic carbon as defined herein having a Bacon Anisotropy Factor (BAF) between about 1.0 and 1.5.

2. The improvement of claim 1 wherein said component is formed of a pyrolytic carbon-coated graphite substrate.

3. The improvement of claim 1 wherein the component is formed of a suitable structural material that is inlaid with pyrolytic carbon inserts.

4. The improvement of claim 3 wherein said inserts are formed of monolithic pyrolytic carbon.

5. The improvement of claim 1 wherein said component is a bridge, saddle, or nut.

6. The improvement of claim 1 wherein said component is a finger slide.

7. The improvement of claim 1 wherein the musical instrument is an acoustic guitar.

8. The improvement of claim 1 wherein the musical instrument is a violin.

9. The improvement of claim 1 wherein the musical instrument is an electric guitar.

10. The improvement of claim 1 where said pyrolytic carbon has a crystallite size between about 20 and 80 angstroms.

11. The improvement of claim 1 where said pyrolytic carbon is unalloyed carbon having a Diamond Pyramid Hardness (DPH) of between 200 and 350 when measured with a 50 gram load.

12. A plectrum device wherein all of its surface that contacts the strings is formed of pyrolytic carbon having a Bacon Anisotropy Factor (BAF) between about 1.0 and 1.5, for use with a stringed musical instrument where the primary means of initiating string vibration is by plucking with a plectrum device.

13. In a stringed musical instrument which incorporates a fretboard as a means of changing primary frequency of the strings, the improvement which comprises one or more of the frets in the fretboard being formed with pyrolytic carbon surfaces that will come in contact with said strings, said pyrolytic carbon having a Bacon Anisotropy Factor (BAF) between about 1.0 and 1.5.

* * * * *